US006948985B1

(12) United States Patent
Perz

(10) Patent No.: US 6,948,985 B1
(45) Date of Patent: Sep. 27, 2005

(54) CONNECTOR

(76) Inventor: Richard Perz, 12 Perez La., Red Hook, NY (US) 12571

( * ) Notice: Subject to any disclaimer, the term of this patent is extended or adjusted under 35 U.S.C. 154(b) by 21 days.

(21) Appl. No.: 10/727,419

(22) Filed: Dec. 4, 2003

(51) Int. Cl.[7] ..... H01R 17/18

(52) U.S. Cl. ..... 439/668; 439/638; 439/363; 439/593

(58) Field of Search ..... 439/668–674, 439/352, 355, 363, 638, 593

(56) References Cited

U.S. PATENT DOCUMENTS 4,867,697 A 9/1989 Borges
5,158,484 A * 10/1992 Chou ..... 439/668
5,230,641 A 7/1993 Wharton
5,569,053 A 10/1996 Nelson et al.
5,626,496 A 5/1997 Hahn
5,775,952 A 7/1998 Lu
5,993,262 A * 11/1999 Kowdynski et al. ..... 439/638
6,116,960 A 9/2000 Lloyd et al.
6,354,862 B1 3/2002 Matso
6,695,648 B2 * 2/2004 Liao ..... 439/668
6,739,914 B2 * 5/2004 Strandfelt ..... 439/668
6,764,347 B1 * 7/2004 Plishner ..... 439/668

* cited by examiner

*Primary Examiner*—Truc Nguyen

(57) ABSTRACT

A connector is provided for use with a socket such as used in a motor vehicle for supplying electrical power to an appliance. The connector has an inner end for placement in the socket and an outer end remote from the socket. An expander which has a passageway extending through it with a thread in the passageway. A collet is mounted on the expander. The collet has a cylindrical exterior and has an opening extending through it. The opening is cylindrical but the opening toward the inner end is substantially smaller than the opening toward the outer end and with the opening between the inner end and the outer end being tapered. The expander is adapted to slide within the collet and the collet has a plurality of slots extending from the outer end part way toward the inner end. A flange is mounted at the inner end of the connector in contact with the collet. A shaft is mounted in the passageway of the expander and has threads engaging the threads in the passageway. A channel is located through the shaft.

11 Claims, 2 Drawing Sheets

CONNECTOR

BACKGROUND OF THE INVENTION

1. Field of the Invention

This invention relates to connectors and, more particularly, relates to an electrical connector for connecting various electrical devices to the electrical socket in a motor vehicle to supply power to devices, such as a wireless telephone and, even more particularly to such an electrical connector that can be firmly secured in such a socket, while being capable of being readily removed.

2. Prior Art

The electrical socket of a vehicle is used today to power many electrical devices. Such sockets are widely employed far beyond the initially-intended purpose of heating a coil to light a cigar or cigarette. One difficulty with the use of a socket of a motor vehicle is that the connector becomes loose in the socket thereby breaking electrical contact, or even worse, causing the connector completely to fall from the socket. Besides obtaining a connection between the socket and the connector, which resists the vibrations of the motor vehicle, there is often a need to have the electrical device supported by the socket. One electrical device that needs such support is a wireless telephone. Wireless phones are increasingly popular and motor vehicle laws, for reasons of safety, prohibit the holding of a wireless phone by the driver when the motor vehicle is in operation. Therefore, a connector which can be secured sufficiently in the socket to hold a wireless phone would provide a substantial service in holding a wireless phone and avoid unwanted alterations to the dashboard of a motor vehicle.

The problem of a connector for use in the socket of a motor vehicle has been dealt with in the past. One such patent is the Nelson et al Patent, U.S. Pat. No. 5,569,053 which uses locking fingers to expand against the socket thereby securing the connector in the socket. The locking fingers are displaced outwardly in response to the longitudinal movement of the outer sleeve from a retracted position to a forward position. Such a device provides a positive lock but actuation and release of the locking fingers is achieved by pushing and pulling of the connector which can damage the socket as well as the dashboard of the motor vehicle in which the socket is mounted. The device taught by Nelson et al is also complex and thus expensive to produce.

OBJECTS

The objects of this invention are as follows:

A connector which can be secured within and removed from a socket without pushing and pulling against the socket.

A connector which is simple in design.

A connector which is comparatively inexpensive to produce.

A connector which is durable.

A connector which can be secured to a socket with sufficient strength to support an electrical device.

SUMMARY OF THE INVENTION

A connector is provided for use with a socket such as used in a motor vehicle for supplying electrical power to an appliance. The connector has an inner end for placement in the socket and an outer end remote from the socket. An expander is provided which has a passageway extending through it. A collet which has an opening through it is mounted on the expander. The expander is adapted to slide within the collet. The collet has a plurality of slots extending from the outer end toward the inner end. A flange is mounted at the inner end of the connector in contact with the collet. A shaft is secured to the flange. The shaft is mounted in the passageway of the expander. The shaft and the expander have interacting means to cause the expander to move along the shaft when the expander is turned. A positive contact is mounted on the shaft at the inner end and a negative contact is mounted on the collet.

DESCRIPTION OF THE NUMERALS

| NUMERAL | DESCRIPTION |
|---|---|
| 11 | Expander |
| 13 | Outer End |
| 15 | Socket |
| 17 | Inner End |
| 19 | Turn Collar |
| 21 | Groove Surface |
| 23 | Tapered Section |
| 25 | Cylindrical Section |
| 27 | Passageway |
| 29 | Threads (Passageway) |
| 31 | Shaft |
| 33 | Outer Thread |
| 35 | Electrical Appliance |
| 37 | Threads (Shaft) |
| 39 | Flange |
| 41 | Collet |
| 43 | Channel |
| 45 | Groove |
| 47 | Opening |
| 48 | Cylindrical Portion |
| 49 | Tapered Portion |
| 51 | Exterior Surface |
| 53 | Slots |
| 54 | Raised Ridges |
| 55 | Positive Contact |
| 57 | Positive Terminal |
| 59 | Negative Contact |
| 61 | Negative Terminal |
| 63 | Electric Leads |

DETAILED DESCRIPTION OF THE PREFERRED EMBODIMENT

Figure 1:
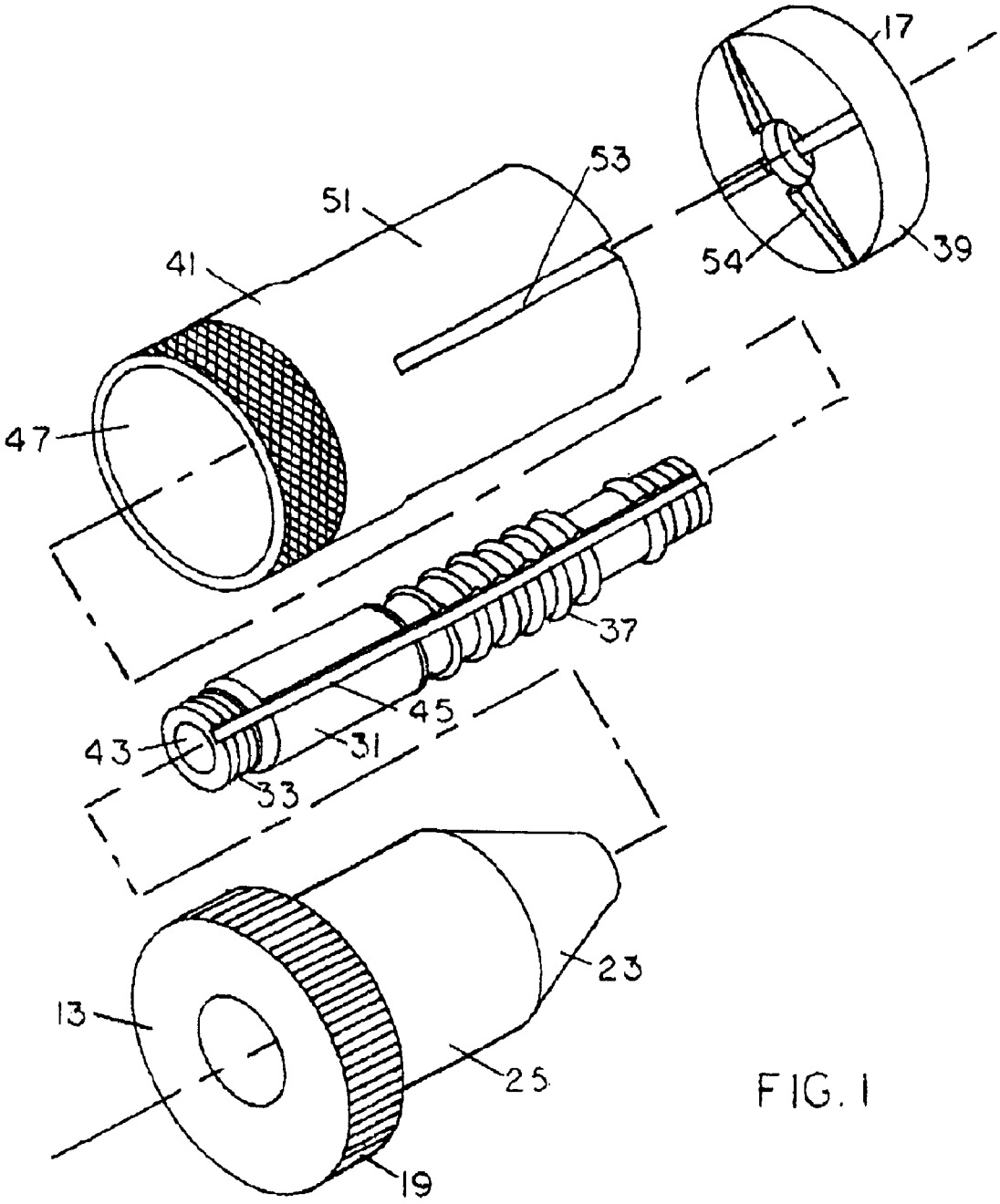
FIG. 1 is a perspective exploded view of the connector.

Referring now to FIG. 1, the various components of the connector are shown and the manner in which the components fit together. The connector includes an expander 11 which has three separate sections. At the outer end 13 of the connector, that is the end most remote from the socket 15 into which the connector is to be placed. The opposite end of the connector is the inner end 17 which is placed into the socket 15. The expander 11 has a turn collar 19. The turn collar 19 is cylindrical. The turn collar 19 is shown with a grooved surface 21 to permit the turn collar 19 to be easily gripped to provide for the turning of the entire expander 11. It is important that the turn collar 19 have a grooved surface or other rough surface 21 to permit the turn collar 19 to be readily gripped to provide for the turning of the expander 11. At the opposite end of the expander 11 there is a tapered section 23 which has a circular cross section. The tapered section 23, which is toward the inner end 17 is substantially longer than the length of the turn collar 19. Between the tapered section 23 and the turn collar 19 there is a cylindrical section 25 which is longer than the tapered section 23. The diameter of the cylindrical section 25 is less than the diameter of the turn collar 19 and the diameter of the tapered section 23, where it connects to the cylindrical section 25, is the same as the cylindrical section 25. Since the tapered section 23 is tapered, the diameter of the tapered section 25 is reduced from the cylindrical section 25 toward the inner end 17.

The expander 11 has a passageway 27 through it from the inner end 17 to the outer end 13. The passageway 27 is also circular in cross section. Toward the inner end 17, the passageway 27 of the expander 11 is threaded with threads 29 which are comparatively coarse.

Figure 3:
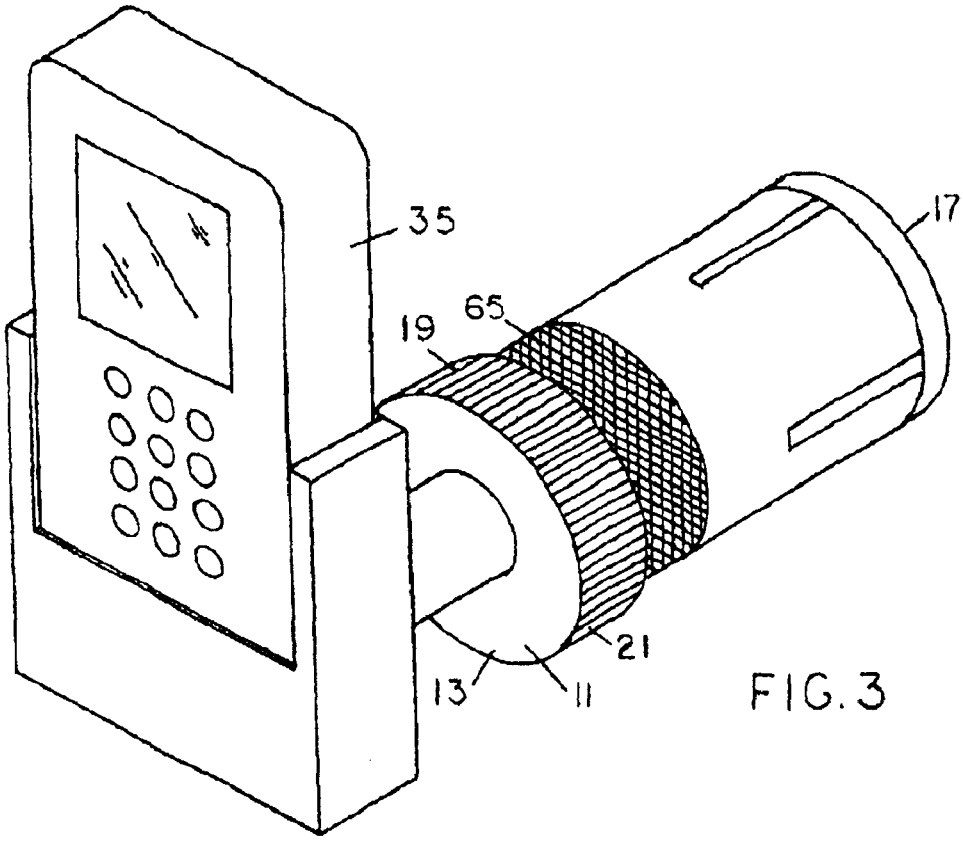
FIG. 3 is a perspective view of the connector with a wireless telephone mounted on it.

Located in the passageway 27 is a shaft 31. The shaft 31 extends from the outer end 13 where the shaft 31 is threaded with an outer thread 33 which is comparatively fine. The outer thread 33 at the outer end 13 is used, as seen in FIG. 3, to connect an electrical appliance 35 to the shaft 31. Generally, in the center of the shaft 31, between the outer end 13 and an inner end 17, the shaft 31 has threads 37 which are compatible with the threads 29 in the passageway 27. At the inner end 17, the shaft 31 is connected b y a rigid connection to a flange 39. In this way, the flange 39 and the shaft 31 cannot rotate in relation to one another.

The shaft 31 which, as stated, is located concentrically within the expander 11, is located along with the expander 11 within a collet 41. The shaft 31 has a channel 43 which is circular in cross section and is concentrically located through it. A groove 45 is also located longitudinally along the length of the shaft 31 and is used as is hereinafter explained. The collet 41 as to its exterior, is a cylindrical member. An opening 47 extends through the collet 41. Toward the outer end 13, the opening 47 in the collet 41 has a cylindrical portion 48, having a diameter comparable to the cylindrical section 25 of the expander 11. The opening 47, toward the inner end 17, has a tapered portion 49 which tapers to a smaller diameter comparable to the tapered section 33 of the adapter 11. The tapered portion 49 of the opening 47 is located generally in the mid section of the collet 41. The opening 47 is cylindrical but tapers to a smaller and smaller diameter as the opening 47 extends toward the inner end 17 so as to cause the expander 11 to expand the collet 41. Through the collet 41 from its exterior surface 51 to the opening 47 are a series of slots 53 extending from the inner end 17 generally half way the length of the collet 41 toward the outer end 13. The slots 53 are preferably equally spaced above the periphery of the collet 41 and preferably number at least four. On the face of the flange 39 which contacts the collet 41, there is a pair of raised ridges 54 shown in the configuration of a cross. The raised ridges 54 engage the slots 53 preventing the collet 41 from rotating in relation to the flange 39.

The shaft 31, at the inner end 17, is rigidly secured to the flange 39. The flange may have an opening through it into which the shaft 31 may be secured or the shaft 31 and the shaft 31 and the flange 39 may be constructed in one piece.

Figure 2:
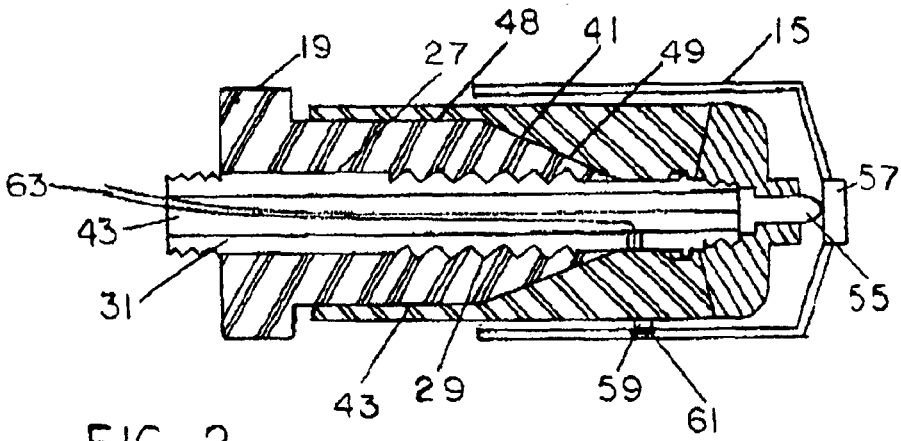
FIG. 2 is a cross-sectional view of the connector showing the positive an negative connectors with the connector placed in a socket.

In the channel 43 through the shaft 31 at the inner end 17 beyond the flange 39 there is a positive contact 55 to connect to the positive terminal 57 of the power supply of the vehicle. The positive terminal 57of the power supply of the vehicle is located in the socket 15 as seen in FIG. 2. On the collet 41, toward the flange 39, a negative contact 59 is located on the exterior surface 51 of the collet 41 to connect with the negative terminal 61 of the power supply of the motor vehicle. Electric leads 63 from the positive contact 55 and the negative contact 59 extend through the channel 43 in the shaft 31 to the outer end 13 of the shaft 31 for connection to the electrical device 35. The groove 45, which is optional, may also be used as a path for wires extending from the inner end 17 to the outer end 13.

The shaft 31 and the collet 41 retain the same linear relationship to one another as the connector is being used. As the expander 11 is turned on the shaft 31, it moves either toward or away from the inner end 17 depending upon the direction that the expander 11 is turned by rotation of the turn collar 19. As the expander 11 moves toward the inner end 17, the tapered section 21 of the expander 11 moves toward the inner end 17, the tapered section 21 of the expander 11 is forced against the tapered portion 41 of the collet 41 forcing the collet 41 to expand. The expansion of the collet 41 toward the inner end 17is made possible by the slots 53 as the expander 11 turns within the collet 41. The collet 41 thus presses firmly against the socket 15 to secure the connector in the socket 15. By turning the turn collar 19 in the opposite direction, the collet 41 is released and the connector may then be removed from the socket 15. The tightening and releasing of the collet 41 is achieved without pushing and pulling on the socket 15. The collet 41 has a knurled area 65 adjacent to the turn collar 19 which can be held should the connector be sufficiently loose in the socket 15 so that the collet 4d1 will turn with the turn collar 19 unless the collet is held in place.

As seen in FIG. 3, a wireless phone is shown as the electrical appliance 35 that can be held by the connector due to the degree of force of the collet 41 expanding against the socket 15.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A connector for use with a socket such as used in a motor vehicle for supplying electrical power to an appliance, the connector having an inner end for placement in the socket and an outer end remote from the socket, such connector comprising:

an expander having a passageway extending through it;

a collet having an opening through it mounted on the expander, the expander being adapted to slide within the collet, the collet having a plurality of slots extending from the outer end toward the inner end;

a flange mounted at the inner end of the connector in contact with the collet;

a shaft secured to the flange mounted in the passageway of the expander, the shaft and the expander having interacting means to cause the expander to move along the shaft when the expander is turned; and a positive contact mounted on the shaft at the inner end and a negative contact mounted on the collet.

2. A connector according to claim 1 wherein the expander includes a turn collar located toward the outer end.

3. A connector according to claim 1 wherein the interlocking means is threads on the passageway of the expander and threads on the shaft.

4. A connector according to claim 1 wherein the flange has ridges which engage the slots in the collet.

5. A connector according to claim 1 wherein the expander has a turn collar toward the outer end and a tapered section toward the inner end with a cylindrical section between the tapered section and the turn collar.

6. A connector according to claim 1 wherein the opening through the collet is cylindrical and is substantially smaller toward the inner end than toward the outer end and the opening between the inner end and the outer end is tapered.

7. A connector for use with a socket such as used in a motor vehicle for supplying electrical power to an appliance, the connector having an inner end for placement in the socket and an outer end remote from the socket, such connector comprising:

an expander having a passageway extending through it, the passageway having a circular cross section with a coarse thread in it toward and within the tapered section;

a collet mounted on the expander having a cylindrical exterior and having an opening extending through it, the opening being cylindrical, the opening toward the inner end being substantially smaller than the opening toward the outer end and with the opening between the inner end and the outer end being tapered, the expander being adapted to slide within the collet, the collet having a plurality of slots extending from, the outer end part way toward the inner end;

a flange mounted at the inner end of the connector in contact with the collet;

a shaft mounted in the passageway of the expander and having threads engaging the threads in the passageway and, the shaft having a channel located through it; and a positive contact mounted at the inner end of the shaft and a negative contact on the collet.

8. A connector according to claim 7 wherein the flange has ridges which engage the slots in the collet.

9. A connector according to claim 7 wherein the expander has a turn collar toward the outer end and a tapered section toward the inner end with a cylindrical section between the tapered section and the turn collar.

10. A connector for use with a socket such as used in a motor vehicle for supplying electrical power to an appliance, the connector having an inner end for placement in the socket and an outer end remote from the socket, such connector comprising:

an expander having a turn collar toward the outer end and a tapered section toward the inner end with a cylindrical section between the tapered section and the turn collar, the expander having a passageway extending through it with a circular cross section with a thread in it toward and within the tapered section;

a collet mounted on the expander having a cylindrical exterior and having an opening extending through it, the opening being cylindrical and being substantially smaller toward the inner end than the opening toward the outer end and with the opening between the inner end and the outer end being tapered, the expanded being adapted to slide within the collet, the collet having a plurality of slots extending from the outer end part way toward the inner end;

a flange located at the inner end of the connector in contact with the collet;

a shaft mounted in the passageway of the expander and having threads engaging the threads in the passageway and being rigidly secured to the flange, the shaft having a channel located concentrically through it; and a positive contact mounted on the inner end of the shaft and a negative contact on the exterior of the collet.

11. A connector according to claim 10 wherein the flange has ridges which engage the slots in the collet.

* * * * *